US007794262B2

(12) United States Patent
Briant et al.

(10) Patent No.: US 7,794,262 B2
(45) Date of Patent: Sep. 14, 2010

(54) CONNECTOR ASSEMBLY WITH ELECTROMAGNETIC INTERFERENCE CONTACTS

(75) Inventors: Eric David Briant, Dillsburg, PA (US); Michael Warren Fogg, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 223 days.

(21) Appl. No.: 12/188,592

(22) Filed: Aug. 8, 2008

(65) Prior Publication Data

US 2010/0035459 A1 Feb. 11, 2010

(51) Int. Cl.
*H01R 13/627* (2006.01)

(52) U.S. Cl. ..... 439/352; 439/108; 439/607.28; 439/939

(58) Field of Classification Search ..... 439/108, 439/352, 353, 354, 357, 358, 378, 607.28, 439/939
See application file for complete search history.

(56) References Cited

U.S. PATENT DOCUMENTS 6,394,824 B1 * 5/2002 Huang ..... 439/108
6,431,887 B1 * 8/2002 Yeomans et al. ..... 439/108
6,454,577 B1 * 9/2002 Yi ..... 439/108
6,485,315 B1 11/2002 Hwang
6,619,989 B1 * 9/2003 Yi ..... 439/607.48
6,655,979 B1 * 12/2003 Lee ..... 439/357
6,830,472 B1 12/2004 Wu
6,860,749 B1 3/2005 Wu
7,029,311 B2 4/2006 Peloza
7,083,459 B1 * 8/2006 Wu et al. ..... 439/354
2010/0035459 A1 * 2/2010 Briant et al. ..... 439/352

* cited by examiner

*Primary Examiner*—James Harvey

(57) ABSTRACT

A connector assembly is configured to mate with a receptacle assembly. The receptacle assembly includes a mating connector within an interior chamber of the receptacle assembly. The interior chamber is defined by an inner surface of the receptacle assembly that is electrically connected to an electrical ground. The connector assembly includes a housing and a latch. The housing includes a mating end configured to be inserted into the interior chamber of the receptacle assembly to mate with the mating connector. The latch includes a securing protrusion and a spring finger. The securing protrusion is configured to mechanically engage the aperture of the inner surface to secure the housing with respect to the receptacle assembly. The spring finger is shaped to electrically engage the inner surface of the receptacle assembly when the connector assembly mates with the receptacle assembly such that the latch is electrically connected to the electrical ground.

20 Claims, 3 Drawing Sheets

CONNECTOR ASSEMBLY WITH ELECTROMAGNETIC INTERFERENCE CONTACTS

BACKGROUND OF THE INVENTION

The subject matter herein generally relates to connector assembles and, more particularly, to a connector assembly having electromagnetic interference contacts.

Various types of connector assemblies mate with receptacle assemblies in order to provide data communication between the connector and receptacle assemblies. Known receptacle assemblies typically include a mating connector disposed within an interior chamber of the receptacle assembly. The mating connector mates with the connector assembly when the connector assembly is inserted into the interior chamber. The interior chamber is defined by an inner surface of the receptacle assembly. The inner surface may be electrically connected to an electrical ground.

The connector assembly includes a latch that latches with the mating connector. The latch engages the mating connector to latch and secure the connector assembly to the mating connector. The latch may include a dimple or other feature that engages the inner surface of the receptacle assembly. The engagement between the dimple and the inner surface provides a single electrical connection between the latch and the inner surface. As the inner surface may be electrically connected to the electrical ground, the engagement of the dimple with the inner surface may electrically connect the latch with the electrical ground.

This single electrical connection between the latch and the electrical ground may be insufficient to shield the connector assembly from electromagnetic interference ("EMI"). For example, EMI may "leak," or pass from the connector assembly to the receptacle assembly around the latch when the connector and receptacle assemblies are mated. Some known connectors have included additional components to attempt to provide additional electrical connections between the connector assembly and the electrical ground. The additional components may add to the cost and complexity of manufacturing the connector assemblies. Moreover, the latches of known connector assemblies typically have very little free space that maybe used to include additional components that provide these additional electrical connections.

Thus, a need exists for a connector assembly that includes additional electrical connections between the connector assembly and the electrical ground, with little or no increase to the cost and complexity of manufacturing the connector assembly.

BRIEF DESCRIPTION OF THE INVENTION

In one embodiment, a connector assembly is configured to mate with a receptacle assembly. The receptacle assembly includes a mating connector within an interior chamber of the receptacle assembly. The interior chamber is defined by an inner surface of the receptacle assembly that is electrically connected to an electrical ground. The inner surface includes an aperture. The connector assembly includes a housing and a latch. The housing is configured to mate with the receptacle assembly and includes a mating end configured to be inserted into the interior chamber of the receptacle assembly to mate with the mating connector. The latch is coupled to the housing and includes a securing protrusion and a spring finger. The securing protrusion is configured to mechanically engage the aperture of the inner surface to secure the housing with respect to the receptacle assembly. The spring finger is shaped to electrically engage the inner surface of the receptacle assembly when the connector assembly mates with the receptacle assembly such that the latch is electrically connected to the electrical ground.

In another embodiment, a plug connector assembly is configured to be inserted into a receptacle assembly to mate with a mating connector. The receptacle assembly includes a connector cage with the mating connector disposed within the connector cage. The plug connector assembly includes a housing and a latch. The housing has a mating end that is configured to mate with the mating connector. The latch is coupled to the housing and includes a latching end that is configured to latch and unlatch with the mating connector. The latch includes an actuating portion that is configured to actuate the latching end. The latch includes a protrusion and a spring finger. The protrusion is configured to mechanically engage the connector cage to secure the mating end in the connector cage. The spring finger is configured to electrically connect the latch with the connector cage. The spring finger extends between the latching end and a spring finger end with a separation gap provided between the spring finger end and the actuating portion.

In another embodiment, another connector assembly is configured to be at least partially inserted in a connector cage of a receptacle assembly to mate with a mating connector in the receptacle assembly. The connector cage is electrically connected to an electrical ground. The connector assembly includes a housing and a latch. The housing includes a mating end that is configured to mate with the mating connector. The latch is coupled to the housing and includes a latching end that is configured to secure the mating end with the mating connector. The latch also includes a protrusion that is configured to secure the latch with the connector cage. A spring finger of the latch is configured to electrically connect the latch with the connector cage such that the connector assembly is electrically connected to the electrical ground. The spring finger is integrally formed with the latch.

DETAILED DESCRIPTION OF THE INVENTION

Figure 1:
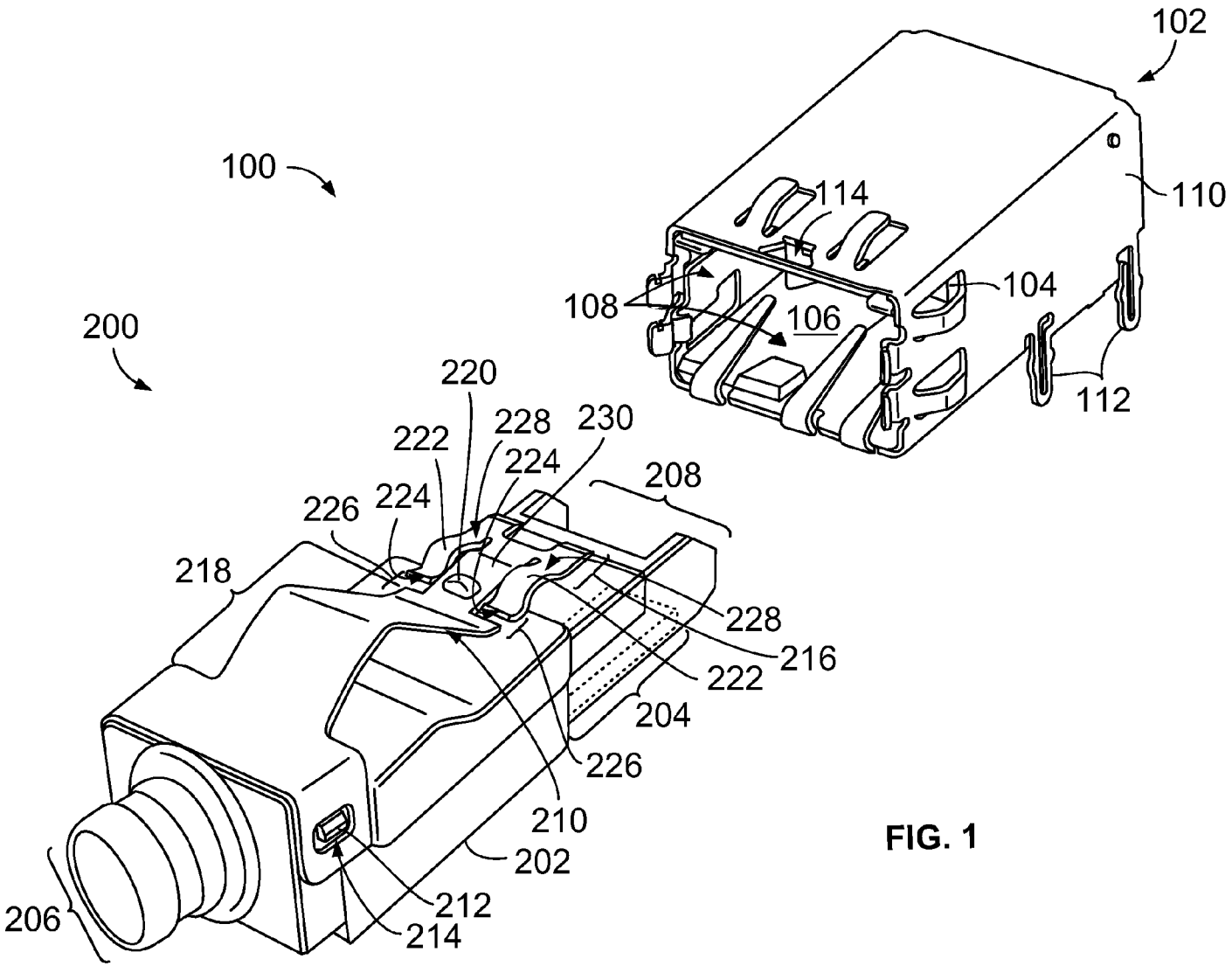
FIG. 1 is a perspective view of a connector system in accordance with one embodiment.

FIG. 1 is a perspective view of a connector system 100 according to one embodiment. The connector system 100 includes a connector assembly 200 and a receptacle assembly 102. The receptacle assembly 102 includes a mating connector 104 that is provided in an interior chamber 106 of the receptacle assembly 102. In the illustrated embodiment, the interior chamber 106 is defined by an inner surface 108 of a connector cage 110 of the receptacle assembly 102. The connector cage 110 partially surrounds the mating connector 104. The mating connector 104 may be mounted to a device (not shown) or circuit board (not shown) to electrically connect the mating connector 104 with the device or circuit board. The connector cage 110 may be mounted to the device or circuit board to electrically connect the connector cage 110 and the inner surface 108 with an electrical ground. For example, the connector cage 110 is formed from a conductive material in one embodiment. Mounting pins 112 that extend from the connector cage 110 may be mounted to the device or circuit board to electrically connect the connector cage 110 with the electrical ground of the device or circuit board. The connector cage 110 includes an aperture 114 or other opening that is used to secure the connector assembly 200 with respect to the receptacle assembly 102 in one embodiment, as described below.

In the illustrated embodiment, the connector assembly 200 is a plug connector assembly that is shaped to be inserted into the receptacle assembly 102 to mate with the mating connector 104. In one embodiment, the connector assembly 200 is a High Speed Serial Data Connector (HSSDC2). The connector assembly 200 includes a housing 202 that extends between a mating end 204 and a cable end 206. The housing 202 may may include or be formed from a conductive material such as a metal material. The mating end 208 is inserted into the receptacle assembly 102 and is shaped to mate with the mating connector 104. The cable end 206 receives a cable (not shown). The mating end 204 includes a mating interface 208 that mates with the mating connector 104 to electrically connect the conductors or wires (not shown) in the cable with the mating connector 104.

The connector assembly 200 includes a latch 210 that is coupled to the housing 202. For example, the latch 210 may be coupled to the housing 202 by placing the latch 210 on the housing 202 so that one or more protrusions 212 extending away from the housing 202 are received through one or more windows 214 in the latch 210. The latch 210 may be coupled to the housing 202 in other manners in another embodiment. The latch 210 includes a latching end 216 that latches and unlatches with the mating connector 104. The latch 210 includes an actuating portion 218 that may be used to actuate the latching end 216. In one embodiment, the actuating portion 218 is depressed downwards towards the housing 202 to cause the latching end 216 to slightly bias downward toward the housing 202.

The latch 210 includes a securing protrusion 220 that protrudes away from the latch 210. In the illustrated embodiment, the securing protrusion 220 is provided on a central portion 230 of the latch 210. The central portion 230 is located between the latching end 216 and the actuating portion 218 in the illustrated embodiment. In another embodiment, the securing protrusion 220 may be provided in a different location on the latch 210. The securing protrusion 220 may be used to mechanically engage with the aperture 114 of the connector cage 110 to secure the connector assembly 200 to the receptacle assembly 102. In one embodiment, the mechanical engagement between the securing protrusion 220 and the aperture 114 also provides an electrical connection between the latch 210 and the connector cage 110 such that the latch 210 may be electrically connected to the electrical ground through the latch 210.

In the illustrated embodiment, the latch 210 includes two spring fingers 222. In another embodiment, the latch 210 includes a different number of spring fingers 222. Each of the spring fingers 222 extends from the latching end 216 to a spring finger end 224. The spring finger ends 224 may be located proximate to the actuating portion 218. A separation gap 226 may be provided between each of the spring finger ends 224 and the actuating portion 218. In the illustrated embodiment, each of the spring fingers 222 is connected to the latch 210 only at an opposing end 228 that opposes the spring finger ends 224. In another embodiment, the spring fingers 222 may be connected to the latch 210 at the opposing end 228 and at the spring finger ends 224.

In one embodiment, the spring fingers 222 provide electrical EMI contacts between the connector assembly 200 and the receptacle assembly 102. As described below, the spring fingers 222 are shaped to engage the receptacle assembly 102 with which the connector assembly 200 mates so that the spring fingers 222 provide an electrical connection between the latch 210 and the receptacle assembly 102. For example, the spring fingers 222 may engage the connector cage 110 when the connector assembly 200 mates with the receptacle assembly 102 such that the spring fingers 222 provide an electrical engagement or connection, between the latch 210 and the connector cage 110. As the connector cage 110 may be electrically connected to the electrical ground, the spring fingers 222 can provide an electrical connection between the latch 210 and the electrical ground through the connector cage 110. In one embodiment, the spring fingers 222 are shaped to engage the housing 202 when the connector assembly 200 mates with the receptacle assembly so that the spring fingers 222 provide an electrical connection between the housing 202 and the receptacle assembly through the latch 210. For example, the spring fingers 222 may engage the housing 202 and the connector cage 110 when the connector assembly 200 mates with the receptacle assembly 102 such that the spring fingers 222 provide an electrical engagement or connection between the housing 202 and the connector cage 110 through the latch 210. As the connector cage 110 may be electrically connected to the electrical ground, the spring fingers 222 can provide an electrical connection between the housing 202 and the electrical ground through the latch 210 and the connector cage 110.

The latch 210 and spring fingers 222 may be integrally formed with one another. For example, the latch 210 and spring fingers 222 may be homogeneously coupled with one another. In one embodiment, the latch 210 and spring fingers 222 are stamped and formed from a common sheet of conductive material such as a metal material.

Figure 2:
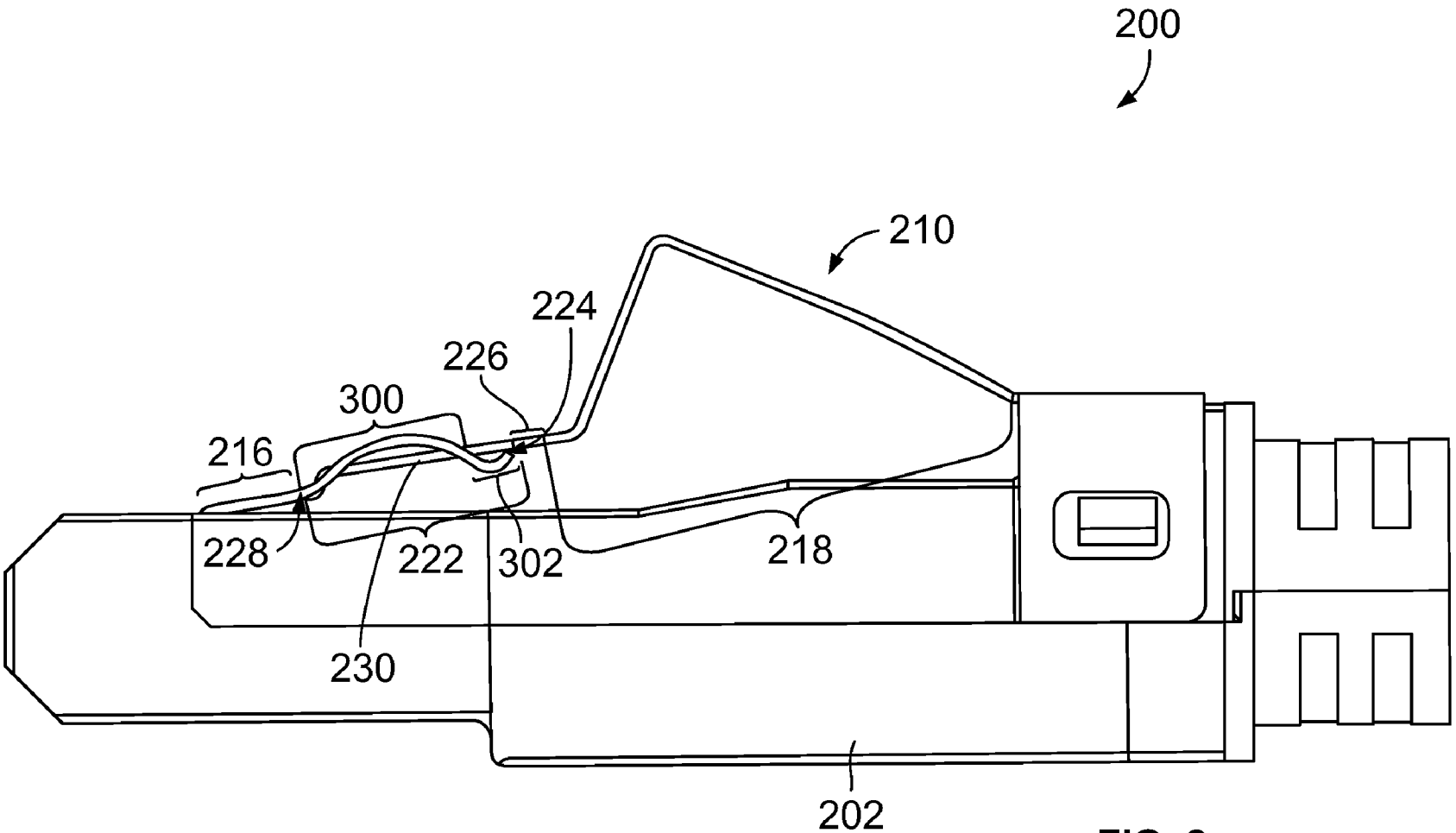
FIG. 2 is an elevational view of a connector assembly shown in FIG. 1.

FIG. 2 is an elevational view of the connector assembly 200. As shown in FIG. 2, the spring fingers 222 may not directly contact the housing 202 when the connector assembly 200 is not mated with a receptacle connector such as the receptacle assembly 102 (shown in FIG. 1). In another embodiment, at least a portion of the spring fingers 222 may directly contact the housing 202 when the connector assembly 200 is not mated with a receptacle connector such as the receptacle assembly 102.

In the illustrated embodiment, each spring finger 222 includes a convex portion 300 and a concave portion 302. The convex portion 300 includes a portion of the spring finger 222 that is bent away from the housing 202. At least part of the convex portion 300 may extend above the central portion 230 of the latch 210. The convex portion 300 extends between the opposing end 228 and the concave portion 302. The opposing end 228 is located at the interface between the latching end 216 and the convex portion 300 of the spring finger 222 in one embodiment. The concave portion 302 includes a portion of the spring finger 222 that is bent towards the housing 202. The concave portion 302 extends between the convex portion 300 and the spring finger end 224. As shown in FIG. 2, the spring finger end 224 and the concave portion 302 are separated from the actuating portion 218 by the separation gap 226. At least a part of the concave portion 302 may extend below the central portion 230 of the latch 210. While the convex and concave portions 300, 302 are shown as substantially curved portions of the spring finger 222 in FIG. 2, one or both of the convex and concave portions 300, 302 may have a different shape. For example, the convex portion 300 may include a non-curved or partially curved part of the spring finger 222 that extends above the central portion 230. The concave portion 302 may include a non-curved or partially curved part of the spring finger 222 that extends below the central portion 230.

Figure 3:
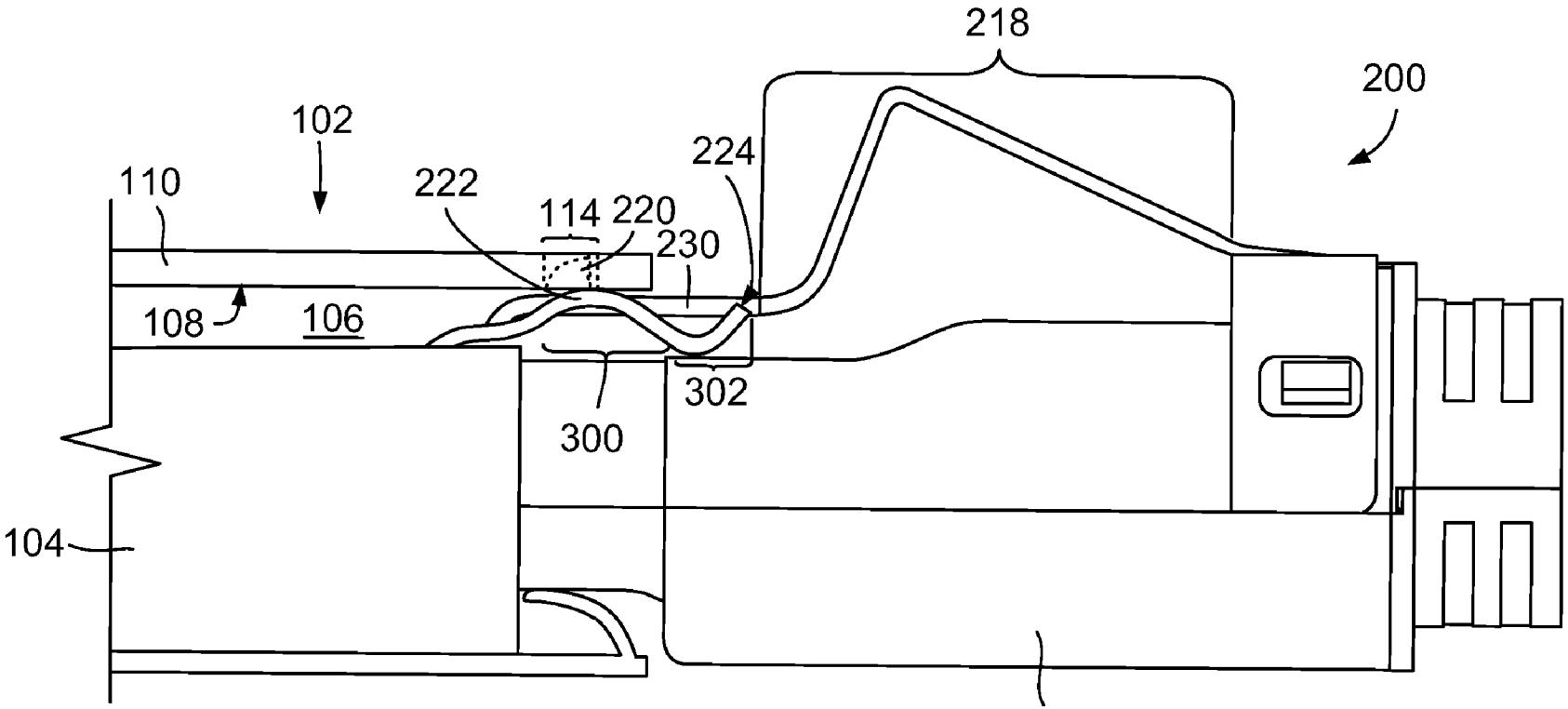
FIG. 3 is a partial cut away view of the connector assembly shown in FIG. 1 mated with the receptacle assembly shown in FIG. 1.

FIG. 3 is a partial cut away view of the connector assembly 200 mated with the receptacle assembly 102. One side of the connector cage 110 is removed in FIG. 3 to better illustrate the interior chamber 106. In the illustrated embodiment, the spring finger 222 is biased downward towards the housing 202 when the connector assembly 200 mates with the mating connector 104. For example, the convex portion 300 may be biased downward with respect to the position of the convex portion 300 by the connector cage 110 when the connector assembly 200 is inserted into the interior chamber 106. The convex portion 300 may engage the inner surface 108 of the connector cage 110 to provide an electrical connection between the latch 210 and the connector cage 110 such that the latch 210 is electrically connected to an electrical ground by the connector cage 110.

In the illustrated embodiment the concave portion 302 is biased downward towards the housing 202 when the connector assembly 200 mates with the mating connector 104 such that at least a part of the concave portion 302 directly contacts the housing 202. For example, the concave portion 302 may be biased downward with respect to the position of the concave portion 302 when the convex portion 300 is biased downward by the connector cage 110 when the connector assembly 200 is inserted into the interior chamber 106.

The concave portion 302 may engage the housing 202 to provide an electrical connection between the housing 202 and the connector cage 110 through the latch 210 such that the housing 202 is electrically connected to an electrical ground by the latch 210 and the connector cage 110. In another embodiment, the concave portion 302 does not engage or contact the housing 202 when the connector assembly 200 mates with the receptacle assembly 102. The concave portion 302 may be biased towards the actuation portion 218 of the latch 210 as the convex and concave portions 300, 302 are biased downward by the connector cage 110. In the illustrated embodiment, the separation gap 226 (shown in FIG. 2) is sufficiently large such that the spring finger end 224 does not engage or directly contact the actuation portion 218.

Also as shown in FIG. 3, the securing protrusion 220 may be received in the aperture 114 of the connector cage 110. The receipt of the securing protrusion 220 into the aperture 114 may assist in securing the connector assembly 200 in the receptacle assembly 102. In one embodiment, the receipt of the securing protrusion 220 in the aperture 114 may provide an electrical connection between the latch 210 and the connector cage 110. For example, the securing protrusion 220 may engage part of the inner surface 108 of the connector cage 110 when the securing protrusion 220 is received in the aperture 114. The latch 210 then may be connected to the electrical ground through the engagement of the securing protrusion 220 in the aperture 114 of the connector cage 110.

One or more embodiments described herein may reduce EMI leakage in the connector assembly 200 by providing additional electrical connections between one or more of the latch 210 and the housing 202 with the connector cage 110 of the receptacle assembly 102. The additional electrical connections can reduce EMI leakage by providing additional electrical connections to the electrical ground through the connector cage 110. In one embodiment, homogeneously coupling the spring fingers 222 and the latch 210 as a one-piece body provides the additional electrical connections without including additional components or parts in the latch 210 or the connector assembly 200.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim 1imitations expressly use the phrase "means for" followed by a statement of function void of further structure.

What is claimed is:

1. A connector assembly configured to mate with a receptacle assembly having an interior chamber defined by an inner surface that is electrically connected to art electrical ground, the connector assembly comprising;

a housing configured to mate with the receptacle assembly, the housing comprising a mating end configured to be inserted into the interior chamber of the receptacle assembly to mate with a mating connector in the interior chamber; and a latch coupled to the housing and comprising a securing protrusion and a spring finger, the securing protrusion configured to mechanically engage an aperture in the inner surface to secure the housing with respect to the receptacle assembly, the spring finger shaped to engage the inner surface of the receptacle assembly when the connector assembly mates with the receptacle assembly such that the latch is electrically connected to the receptacle assembly.

2. The connector assembly of claim 1, wherein the spring finger is shaped such that the spring finger is biased towards the housing when the connector assembly mates with the receptacle assembly such that the spring finger electrically connects the housing with the inner surface of the receptacle assembly.

3. The connector assembly of claim 1, wherein the spring finger comprises a convex portion and a concave portion, the convex portion configured to electrically connect the latch with the inner surface and the electrical ground and the concave portion configured to electrically connect the housing with the inner surface and the electrical ground when the connector assembly mates with the receptacle assembly.

4. The connector assembly of claim 1, wherein the latch comprises a latching end and an actuating portion, the latching end configured to latch to and unlatch from the mating connector, the actuating portion configured to actuate the latching end, the spring finger extending from the latching end to a spring finger end, wherein a separation gap is provided between the spring finger end and the actuating portion.

5. The connector assembly of claim 4, wherein the separation gap prevents the spring finger end from contacting the actuating portion when the connector assembly mates with the receptacle assembly and the spring finger is biased towards the housing.

6. The connector assembly of claim 1, wherein the spring finger is coupled to the latch at only one end of the spring finger.

7. The connector assembly of claim 1, wherein the spring finger is homogeneously coupled with the latch.

8. The connector assembly of claim 1, wherein the latch comprises a plurality of the spring fingers such that the spring fingers and the securing protrusion are configured to engage the inner surface to provide at least three electrical connections between the latch and the electrical ground.

9. The connector assembly of claim 1, wherein the spring finger does not directly contact the housing prior to mating the connector assembly with the receptacle assembly.

10. A plug connector assembly configured to be inserted into a connector cage of a receptacle assembly to mate with a mating connector, the plug connector assembly comprising:

a housing having a mating end configured to mate with the mating connector when the housing is loaded into the connector cage; and a latch coupled to the housing and comprising a latching end configured to latch to and unlatch from the mating connector, the latch comprising an actuating portion configured to actuate the latching end, the latch comprising a protrusion and a spring finger, the protrusion configured to mechanically engage the connector cage to secure the mating end in the connector cage, the spring finger configured to electrically connect the latch with the connector cage, wherein the spring finger extends between the latching end and a spring finger end with a separation gap provided between the spring finger end and the actuating portion.

11. The plug connector assembly of claim 10, wherein the spring finger is configured to be biased towards the housing when the plug connector assembly is inserted into the connector cage such that the spring finger electrically connects the housing with the connector cage.

12. The plug connector assembly of claim 10, wherein the separation gap is sufficiently large so that the spring finger end is configured to be displaced towards the actuating portion when the spring finger is biased towards the housing, the spring finger configured to be biased towards the housing when the plug connector assembly is inserted into the connector cage.

13. The plug connector assembly of claim 10, wherein the spring finger comprises a convex portion and a concave portion, the convex portion configured to electrically connect the latch, with the connector cage, the concave portion configured to electrically connect the housing with the connector cage when the plug connector assembly mates with the receptacle assembly.

14. The plug connector assembly of claim 10, wherein the spring finger is only coupled to the latch at an opposing end of the spring finger, the opposing end opposing the spring finger end.

15. The plug connector assembly of claim 10, wherein the spring finger is homogeneously formed with the latch.

16. The plug connector assembly of claim 10, wherein the latch comprises a plurality of the spring fingers such that the spring fingers and the protrusion are configured to engage the connector cage to provide at least three electrical connections between the latch and the electrical ground.

17. A connector assembly configured to be at least partially inserted in a connector cage of a receptacle assembly to mate with a mating connector in the receptacle assembly, the connector cage electrically connected to an electrical ground, the connector assembly comprising:

a housing comprising a mating end configured to mate with the mating connector;

a latch coupled to the housing and comprising a latching end configured to secure the mating end with the mating connector, a protrusion configured to secure the latch with the connector cage, and a spring finger configured to electrically connect the latch with the connector cage such that the connector assembly is electrically connected to the electrical ground, wherein the spring finger is integrally formed with the latch.

18. The connector assembly of claim 17, wherein the spring finger extends from the latching end to a spring finger end, the spring finger end separated from the latch by a separation gap.

19. The connector assembly of claim 17, wherein the spring finger comprises a convex portion and a concave portion, the convex portion configured to electrically connect the latch with the connector cage and the concave portion configured to electrically connect the housing with the connector cage when the connector assembly mates with the receptacle assembly.

20. The connector assembly of claim 17, wherein the spring finger does not directly contact the housing prior to mating the connector assembly with the receptacle assembly.

* * * * *